US006076439A

United States Patent [19]

Dzieman

[11] Patent Number: 6,076,439

[45] **Date of Patent: *Jun. 20, 2000**

[54] TORQUE SCREWDRIVER WITH INDEXING MEANS

[75] Inventor: Stephen E. Dzieman, Bartlett, Ill.

[73] Assignee: Ryeson Corporation, Franklin Park, Ill.

[ * ] Notice: This patent is subject to a terminal disclaimer.

[21] Appl. No.: 09/149,840

[22] Filed: Sep. 8, 1998

[51] Int. Cl.[7] ..... B25B 23/157

[52] U.S. Cl. ..... 81/473; 81/467; 81/474

[58] Field of Search ..... 81/473–476, 467

[56] References Cited

U.S. PATENT DOCUMENTS

| | | | |
|---|---|---|---|
| 3,001,430 | 9/1961 | Cranford | 81/474 |
| 4,041,811 | 8/1977 | Durant | 81/476 |
| 4,063,474 | 12/1977 | Klopping | 81/474 |
| 4,867,019 | 9/1989 | Lankry | 81/474 |
| 4,901,610 | 2/1990 | Larson et al. | 81/473 |

*Primary Examiner*—James G. Smith
*Assistant Examiner*—Lee Wilson
*Attorney, Agent, or Firm*—Marshall, O'Toole, Gerstein, Murray & Borun

[57] ABSTRACT

An improved torque limiting screwdriver including a shaft extending from a first end of the screwdriver body, the shaft including a first indicia thereon, and an adjustment cap arranged to be located at a second end of the screwdriver body. The adjustment cap rotatable to selectively engage a selected detent located on the bottom of the adjustment cap. The selective rotation of the adjustment cap is aligned with indicia on a selected detent, indexing of both the indicia on the shaft and the indicia on the adjustment cap, providing an accurate specific torque value for the torque limiting screwdriver.

11 Claims, 3 Drawing Sheets

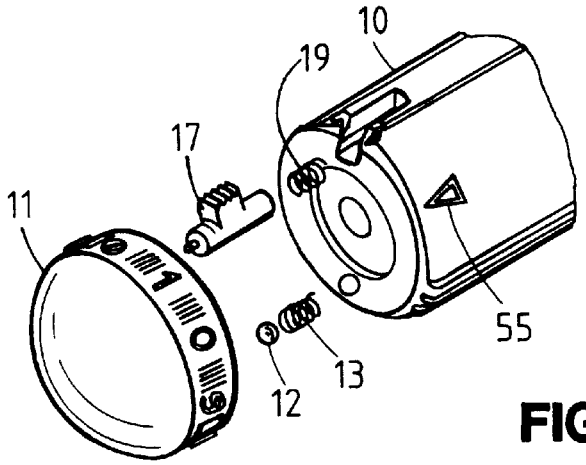
FIG. 4
FIG. 5
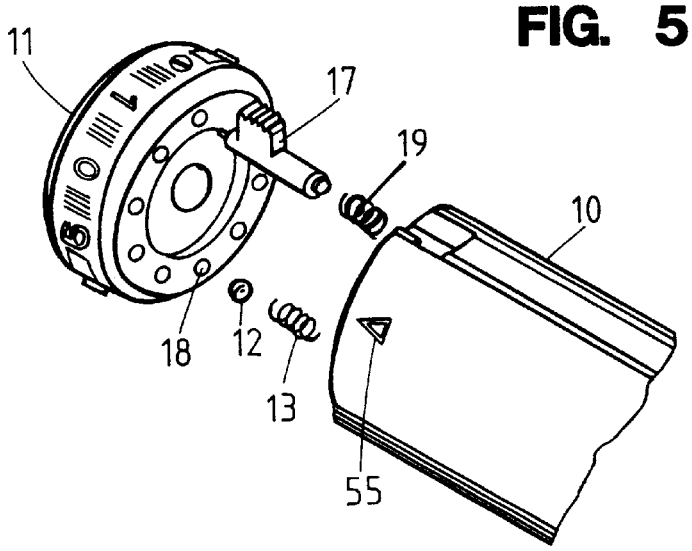
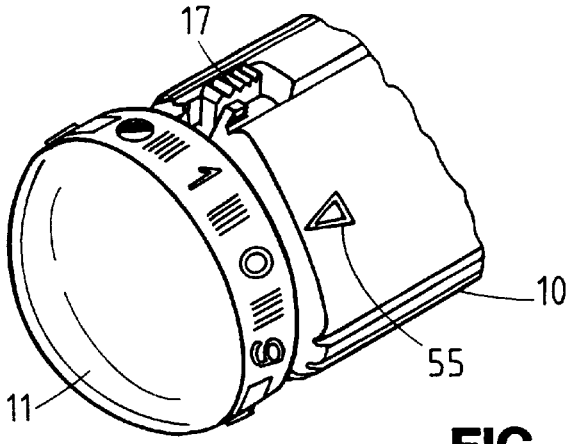
FIG. 6

TORQUE SCREWDRIVER WITH INDEXING MEANS

BACKGROUND OF THE INVENTION

1 . Field of the Invention

The present invention relates to torque screwdrivers. More particularly, the present invention is related to a torque screwdriver, including means to selectively advance the calibrated torque screwdriver in various measurement units. It will precisely position and coordinate indexing numerals on an adjustment cap with other indexing numerals included on the shaft, allowing the operator the ability to select a preset torque value.

2. Background Art

In the past, manufacturers of torque screwdrivers have only had means to advance settings up or down by bringing an indicator mark even with lines on a scale. Such a method is highly disadvantageous in that the scales are divided into lines every 5, 10 or 20 unit increments, or some similar unit increment arrangement. These exact unit increments cause the operator to select only such exact unit increments as shown on the shaft, or guess what the value settings might be between the included incremental lines. This drastically decreases the accuracy of the operator's torque value setting choices.

A search of the background art directed to the subject matter of the present invention conducted in the U.S. Patent and Trademark Office disclosed the following U.S. Pat. Nos.:

| | | | |
|---|---|---|---|
| 2,440,683 | Hattan | 3,896,540 | Ellis |
| 2,491,325 | Mcvey | 4,063,474 | Klopping |
| 2,729,134 | Stanton | 4,901,610 | Larson |
| 2,933,959 | McMahon | 5,501,124 | Ashby |
| 3,001,430 | Cranford | 5,662,012 | Grabovac |

A thorough review of the above-identified patents has concluded that none are believed to claim teach or disclose the particular novel combination of elements and functions set forth in the present invention. While U.S. Pat. Nos. 2,933,959, 3001,430, 4,063,474, and 4,901,610 all include index markings on the shaft, it will be seen that these are the type referred to above where any choice of torque pressure other than indicated by the indexing lines, is merely a matter of guesswork.

Accordingly, it is the object of the present invention to further divide each division into positive incremental and indexable values, making possible increased operator selection for a greater value of torque value settings than has been available in the prior art.

Another object of the present invention is to be sure that each one of the torque value settings is an accurate torque value, eliminating the need for guesswork.

SUMMARY OF THE INVENTION

The present invention can be best understood by the following description: the scale of torque value settings in a given measurement of some predetermined units (e.g., inch-ounces) may consist of several increment lines. For example, a typical scale as utilized in torque screwdrivers might be incremented from 10 to 50 in inch-ounces of torque. It then being divided up into 10s. This means it would be possible to travel up and down the scale from 10 to 20, 20 to 30, etc., up to and including a setting of 50.

Utilization of this arrangement would limit the user to setting the torque to one of only five choices. As in the past, settings between these choices had been done by guessing the values based on a half-turn, quarter-turn, half the distance between two lines, all of which are less than desirable and lack the necessary desirable accuracy.

The user, when lining up the scale increment line with the index mark, is never quite sure of the exact setting the screwdriver is set to, due to parallax error and/or human judgment error. It may be seen that in this respect the settings are purely guesswork. The present invention, accordingly, was designed to eliminate guesswork from the establishment or setting of the torque in the device.

The present invention also increases the amount of settings available. The invention gives the operator a positive feel to its setting selection by using a ball bearing contained in the upper end of the torque screwdriver handle that nests in any one of the spherical pockets or detents included in the adjustable end cap. The spherical pockets are slightly smaller than half the ball bearing diameter. In the adjusting cap at the upper end, positive alignment is given to the setting of the tool. It aligns the marked numbers on the cap to an index mark on the handle, showing the operator the secondary setting they have selected. Thus, the combination of cap setting and the setting shown on the shaft scale. Increment lines appearing past the thimble are added together in combination with indicia on the cap to indicate the exact torque screwdriver setting selected.

The setting established as described above is now the torque value that will be delivered to the fastener upon activation. If required, the torque value setting may be changed by turning the cap on the upper end of the screwdriver in a clockwise or counterclockwise rotation. The included ball bearing will move out of one spherical pocket and into the next pocket, giving the operator a positive feel to its nesting and position each time. Such motion acts to provide click stops for each movement.

The ball bearing utilized in the upper end of the screwdriver body is settled in a positive position in each cap pocket. The force behind the ball bearing is supplied by a compression spring. This force is enough to prevent the setting from being changed by a bump, drop, or jiggle of the torque screwdriver. It becomes necessary for a full operation to grasp the adjustment cap and physically turn it clockwise or counterclockwise to change its position and setting.

As seen from the foregoing, the improvement in the present invention comprises a rotatable cap member arranged to be located at one end of the usual screwdriver body. The cap includes an exterior wall portion with a number of index numbers on it, the interior portion of the upper end cap acting with the body of the screwdriver to move a ball bearing from one pocket into the next cap pocket. It can be seen that rotation of the cap relative to the body adjusts the torque of the screwdriver.

The interior mechanism and drive mechanism of the present screwdriver, with the exception of the upper cap and its associated settings, is similar to that found in U.S. Pat. No. 4,063,474 which issued on Dec. 20, 1997 to Klopping.

The foregoing and additional objects and advantages of the invention will become more apparent as the following detailed description is read in conjunction with the accompanying drawings.

BRIEF DESCRIPTION OF THE DRAWINGS

FIG. 4 is a perspective view, showing how the adjustment end cap is fitted to the body portion of the screwdriver.

FIG. 5 is a perspective view of the present invention, showing the adjustment cap from its underside in relationship to the body of the torque screwdriver.

FIG. 6 is a perspective view of the adjustment end cap of the present invention assembled to the body portion of the torque screwdriver.

DESCRIPTION OF THE PREFERRED EMBODIMENT

Figure 1:
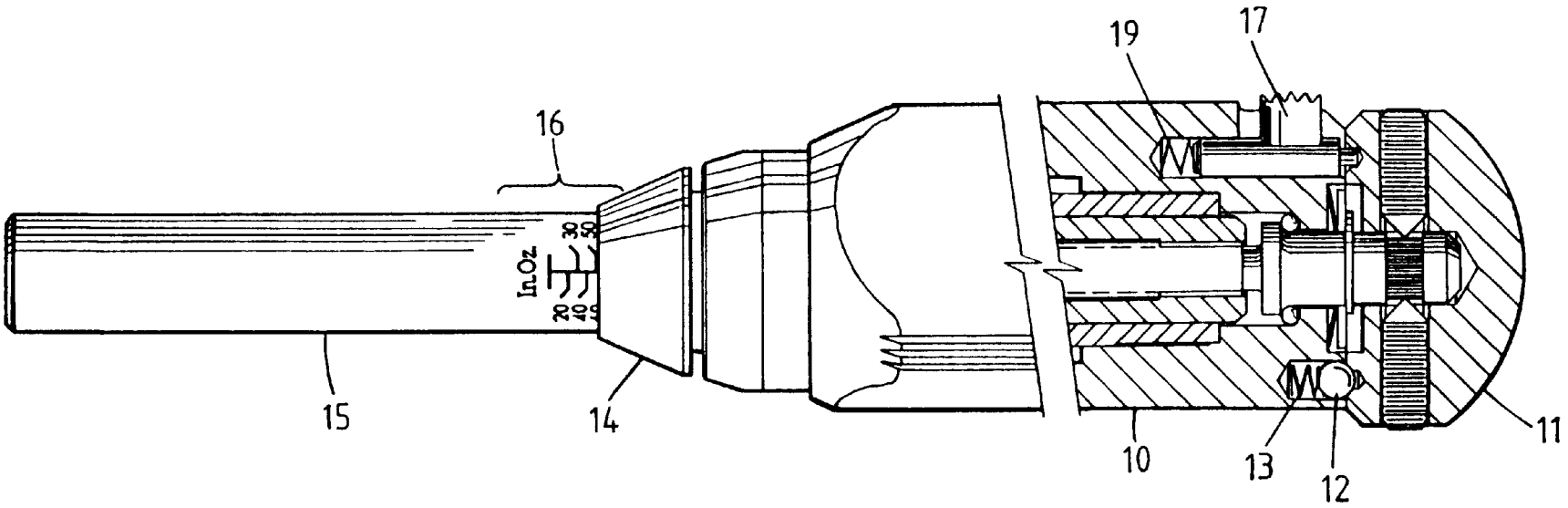
FIG. 1 is a partial plan view of the present invention with the upper portion sectionalized to show the relationship between the adjustable end cap and the upper portion of the torque screwdriver.
Figure 7:
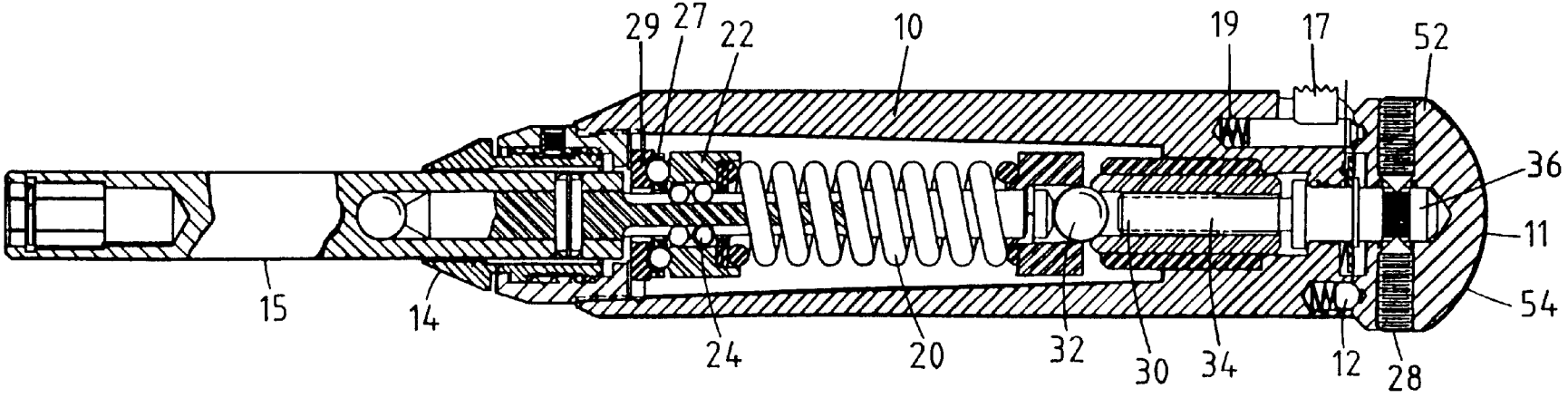
FIG. 7 is a sectional view of the screwdriver of the present invention.

Referring first to FIGS. 1 & 7, the body 10 of the torque screwdriver, as noted previously, is similar to that found in U.S. Pat. No. 4,063,474. Of particular interest in the present invention is the adjustment cap 11 shown positioned on the body 10 and as seen in the sectional view, a ball bearing 12 protrudes partially into the lower side of the adjustment cap. The ball bearing is retained in its position by means of compression spring 13. At the lower end of the screwdriver, in a manner similar to that described in the previous reference, is a shaft 15. At the lower end of shaft 15, the screwdriver of the present invention accepts screwdriver bits in a manner well known to the prior art. Located on shaft 15 are indexing markings 16 which are shown in inch ounces in the present invention. It is to be understood that those markings could be changed to metric equivalents, if so desired.

Figure 2:
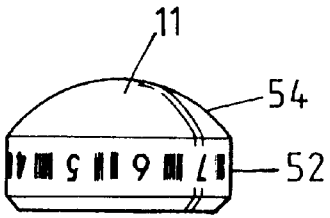
FIG. 2 is a side view of the adjustment cap as utilized in the present invention.

The side view of adjustment cap 11 is shown in FIG. 2. The numerical markings indicating the minor adjustments of the present invention are shown in numeral form. The lower end of end cap 11 includes a plurality of detents 18 arranged in a detent circle form. The detents 18, located on the lower side of adjustment cap 11, are concave openings slightly smaller than half the diameter of ball bearing 12. FIG. 4 shows the manner in which the end cap 11 is assembled to body 10. Included and also shown is ball bearing 12 which is retained in its proper position in the detents 18 by compression spring 13. In a similar manner, FIG. 5 shows the method of assembly wherein the detents 18 can be seen on the lower side of adjustment cap 11. From this figure it can also readily be seen that ball bearing 12 retained in position by compression spring 13 mates with the various detents 18 as the adjustment cap is rotated relative to the body 10.

As shown in FIG. 7, the right end portion of the torque adjusting screw 34 is unthreaded and extends into the adjustment cap 11. The adjustment cap 11 is secured to the end of adjustment screw 34 by screw 28 which extends through a portion of the adjustment cap whereby the adjustment cap 11 can be moved axially with respect to adjusting screw 34.

A spring loaded ball 32 is located at the opposite end of adjustment screw 34 from adjustment cap 11. It operates in conjunction with adjustment cap 11. As previously mentioned, a locking screw 28, as can be seen in FIG. 7, extends through the adjustment cap 11 into threaded engagement with adjustment cap 11 to positively lock the adjustment cap member 11 in the position illustrated when desired.

In addition to the connecting portion 36 at the interior of the adjustment cap 11, the adjustment cap includes an exterior wall portion which generally conforms to the exterior wall of the body 10. A substantially smooth exterior end portion 54 is connected with end portion 52. Thus, it can be appreciated from reference to FIGS. 1 and 7 the adjustment cap 11 provides a smooth comfortable end for the user of the tool.

The torque screwdriver of the present invention will achieve a positive placement for setting that will accurately give the operator an exact torque value setting. Each rotational adjustment of the cap end will, in either a clockwise or counterclockwise direction, nest ball bearing 12 into an associated detent 18. As can be seen in FIGS. 2, 4 and 5, each setting has a corresponding mark showing its set value. The marking 16 on shaft 15 is referred to as the major scale and as indicated by lines. Selected marking 16 appears past the lower edge of thimble 14. The marks on the adjustment cap 11 comprise a minor scale indicated by an index mark 55 on the body 10. In combination, the markings on the major scale and minor scale added together provide the operator with a set torque value that the screwdriver of the present invention will deliver.

Figure 3:
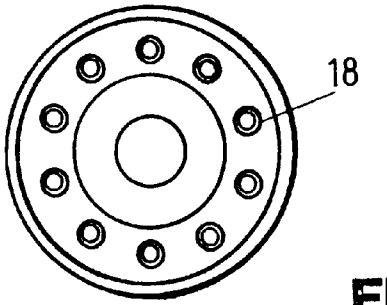
FIG. 3 is a view of the underside or side facing the body of the screwdriver, showing the plurality of detents positioned in a circle included therein.

As shown in the present invention, in FIG. 3, the adjustment cap is divided at its lower end into ten detents 18 giving the operator a choice of ten different settings between every major scale increment on the shaft. For example, if the major scale is incremented in 10, 20, 30, 40, and 50 inch-ounces of torque, the operator may choose one of the ten settings between 10 and 20, 20 and 30, etc. Examples being settings of 10, 11, 12, 13, 14, 15, 16, 17, 18, 19, and 20. Each would have a corresponding mark on the exterior body of the circumference of the outer edge of adjustment cap 11 as seen in FIGS. 2, 4, and 5. Thus, the operator of the screwdriver of the present invention may choose one of ten settings between 10 and 20, 20 and 30, etc. Examples being settings of 10, 11, 12, 13, 14, 15, 16, 17, 18, 19, and 20. Each of these values would have a corresponding mark on the exterior of adjustment cap 11 coinciding with the location of a placement nest or detent 18. In use, the operator will feel the setting nesting itself in an exact placement corresponding to the torque value selected; each movement providing a click stop for each selected value.

While but a single embodiment of the present invention has been shown, it will be obvious to those skilled in the art that numerous modifications may be made without departing from the spirit of the present invention, which shall be limited only by the scope of the claims appended hereto.

What is claimed is:

1. An improved torque limiting screwdriver including a shaft extending from a first end of a body, said shaft including a bit receptacle on an extended end of said shaft, said shaft including a first plurality of indicia thereon, the improvement comprising an adjustment cap having a bottom surface arranged to be located at a second end of said body, and having:

an exterior wall portion generally conforming to said body means;

an exterior end portion;

said end portion connected to said wall portion;

a plurality of spaced detents on the bottom surface of said adjustment cap;

a second plurality of indicia located on the exterior wall portion of said adjustment cap;

a ball bearing mounted at the second end of said body, adapted to selectively engage any of said detents.

2. An improved torque limiting screwdriver as claimed in claim 1 wherein:

said ball bearing is spring loaded in said second end of said body.

3. An improved torque limiting screwdriver as claimed in claim 1 wherein:

said adjustment cap includes a plurality of serrations on the exterior wall portion of said adjustment cap.

4. An improved torque limiting screwdriver as claimed in claim 1 wherein:

said detents are each circumferentially smaller than the circumference of said ball bearing.

5. An improved torque limiting screwdriver as claimed in claim 4 wherein:

said second indicia are each located adjacent to one of said detents to provide an index in response to rotation of said adjustment cap relative to an index point on said body.

6. An improved torque limiting screwdriver as claimed in claim 1 wherein:

there is further included a fixed thimble positioned about said shaft, at said first end of said body.

7. An improved torque limiting screwdriver as claimed in claim 5 wherein:

a first end of said thimble provides an indexing point whereby said first indicia on said shaft are indexed relative to said body.

8. An improved torque limiting screwdriver as claimed in claim 1 wherein:

said adjustment cap is rotatable to selectively engage any one of said detents located on the bottom of said adjustment cap.

9. An improved torque limiting screwdriver as claimed in claim 1 wherein:

said adjustment cap is secured to an adjustment screw included in said body by means of a set screw extending through the exterior wall portion of said adjustment cap and engaging a first end of said adjustment shaft.

10. An improved torque limiting screwdriver including a shaft extending from a first end of a body, said shaft including a bit receptacle, and the shaft including a first plurality of indicia thereon, an adjustment cap arranged to be located at the second end of said body, said body further including an adjustment screw;

and means included in said adjustment cap for securing said adjustment cap to said adjustment screw to retain said cap in position adjacent to the body of said screwdriver;

said adjustment cap further including a plurality of spaced detents on the bottom surface of said adjustment cap;

a second plurality of indicia located on the exterior wall portion of said adjustment cap;

a ball bearing mounted at the second end of said body, adapted to selectively engage any of said detents;

said adjustment cap rotatable to selectively engage any one of said detents located on the bottom of said adjustment cap.

11. An improved torque limiting screwdriver as claimed in claim 1 wherein:

the first indicia of said shaft are indexed relative to said body;

said adjustment cap rotatable to selectively engage any one of said detents located on the bottom of said adjustment cap, whereby in response to the indexing of said first indicia on said shaft and the selective rotation of said adjustment cap is aligned with a numerical value associated with the selected one of said detents;

said indexing of said indicia on said shaft and said indicia located on said adjustment cap in combination having an accurate specific value for said torque limiting screwdriver.

* * * * *